US006213558B1

(12) United States Patent
Axelson et al.

(10) Patent No.: US 6,213,558 B1
(45) Date of Patent: Apr. 10, 2001

(54) PELVIC STABILIZATION DEVICE

(75) Inventors: Peter W. Axelson, Bonny Doon; William M. Richter, Los Gatos, both of CA (US); Jamie H. Noon, Gulshan (BD)

(73) Assignee: Beneficial Designs, Miden, NV (US)

( * ) Notice: Subject to any disclaimer, the term of this patent is extended or adjusted under 35 U.S.C. 154(b) by 0 days.

(21) Appl. No.: 09/339,324

(22) Filed: Jun. 22, 1999

(51) Int. Cl.[7] ..... A47C 31/00
(52) U.S. Cl. ..... 297/464; 297/DIG. 4
(58) Field of Search ..... 297/464, 465, 297/487, 488, DIG. 4; 280/250.1, 290; 128/869

(56) References Cited

U.S. PATENT DOCUMENTS

| | | | | |
|---|---|---|---|---|
| 1,074,615 | | 10/1913 | Folmer . | |
| 1,527,754 | * | 2/1925 | Simon . | |
| 3,640,571 | | 2/1972 | Keropian | 297/384 |
| 3,704,910 | | 12/1972 | Willcott | 297/411 |
| 4,065,179 | * | 12/1977 | Takasaki . | |
| 4,073,537 | | 2/1978 | Hammersburg | 297/384 |
| 4,813,746 | | 3/1989 | Mulholland | 297/488 |
| 4,981,307 | * | 1/1991 | Walsh . | |
| 5,447,356 | | 9/1995 | Snijders | 297/284.3 |
| 5,564,788 | | 10/1996 | Warhaftig | 297/464 |
| 5,678,798 | | 10/1997 | Little | 248/289.11 |

* cited by examiner

*Primary Examiner*—Milton Nelson, Jr.
(74) *Attorney, Agent, or Firm*—John M. Johnson; Kaye, Scholer, Fierman, Hays & Handler LLP

(57) ABSTRACT

A pelvic stabilization device attachable to a wheelchair includes a pelvic support brace and an apparatus for attaching the pelvic support brace to a wheelchair. A pivot apparatus provides movement of the pelvic support brace with respect to the apparatus for attaching the pelvic support brace, the pelvic support brace being pivotable between a first, neutral position and a second, tilted position. A pivot return apparatus is attached to the pelvic support brace to return the pelvic support brace to the first, neutral position from the second, tilted position. A pivot limiting apparatus limits the amount of pivot of the pelvic support brace that is inducible by the pivot apparatus.

19 Claims, 5 Drawing Sheets

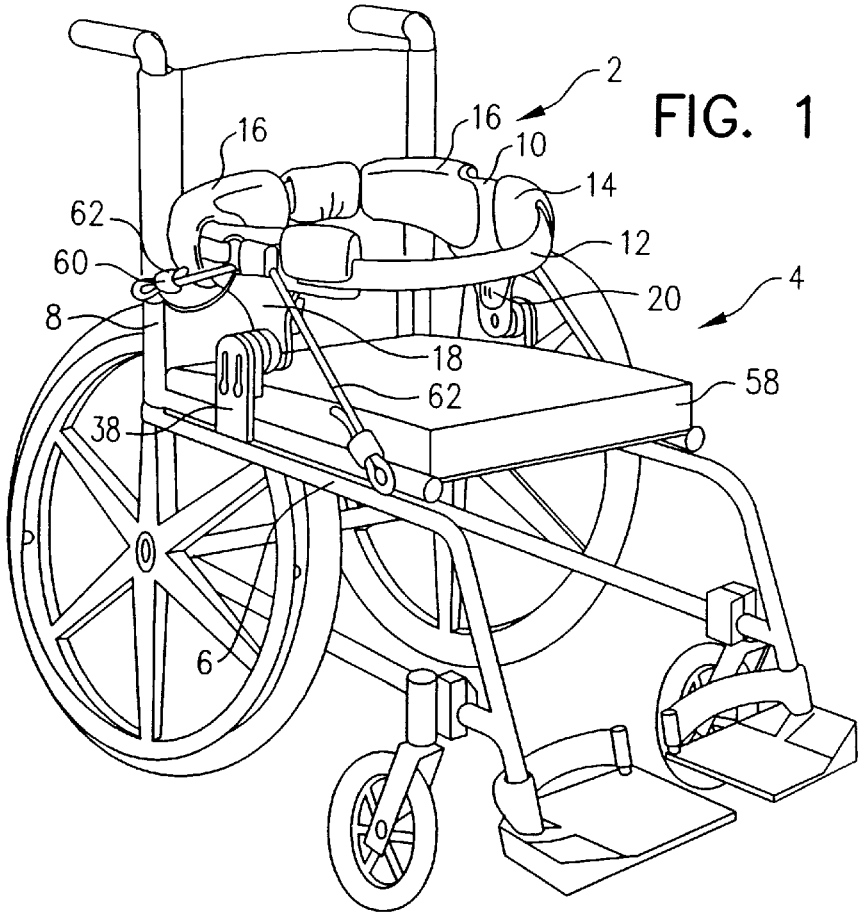
FIG. 1
FIG. 2
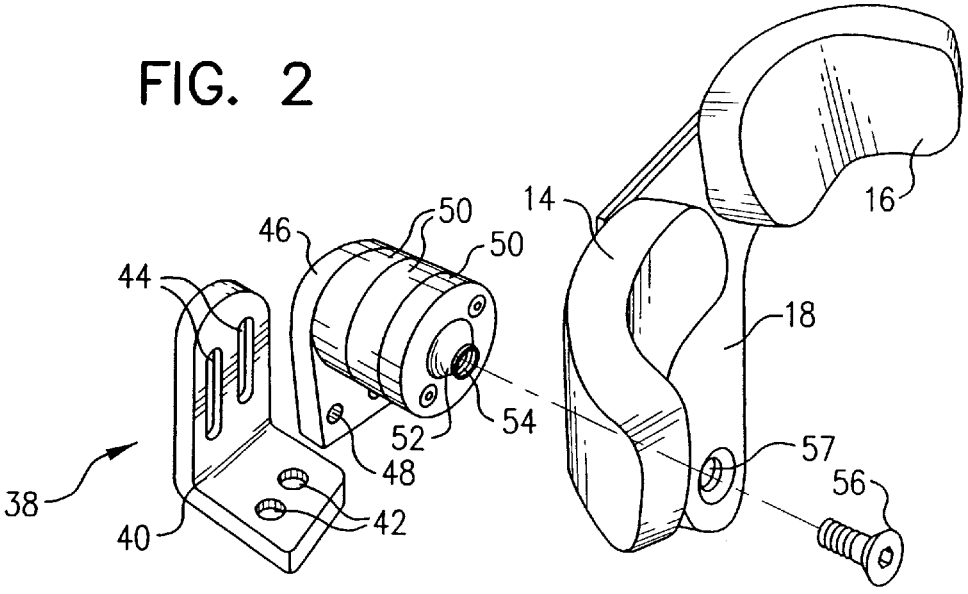

PELVIC STABILIZATION DEVICE

BACKGROUND OF THE INVENTION

Maintaining a proper pelvic posture and providing stability through the pelvis are critical to overall sitting posture. Freedom of movement can be enhanced by achieving a stable base of support. The optimum position for the pelvis is a slight anterior tilt. An effective pelvic support will prevent the pelvis from tilting posteriorly. A posterior pelvic tilt promotes rounding of the upper spine, which can lead to deformity. For a pelvis which posteriorly tilts, the top of the pelvis must be blocked from moving back and the bottom of the pelvis must be stabilized from moving forward. With adequate proximal support, less support is required distally. Therefore, with increased stability of the pelvis, the user is less dependent upon additional supports in order to maintain a functional, upright sitting posture. Individuals using wheelchairs need assistance to maintain pelvic stability.

The neutral posture of the pelvis is a dynamic state which should be allowed to move. Therefore, a rigidly stabilizing pelvic position is not desirable. Currently available pelvic supports either do not control undesired pelvic movement, or lock the pelvis in a static, non-functional position. The subtle movements of the pelvis are critical to maintaining an active posture and should not be rigidly stabilized.

Currently available pelvic stabilization devices do not move with the user and do not provide a dynamic force to help correct the user's posture after allowing movement. Pelvic support devices which do not maintain contact with the pelvis when the user moves are less effective. Currently available devices do not support the pelvis from the front, back, and sides. A combination of devices, often from various sources, must be used to provide support in these areas. This increases the cost of the seating system, adds bulk and weight, and increases time required to install, fit, and adjust the system for growth. Potential hazards presented by improperly used pelvic include strangulation from sliding out of an ill-fitting system, and tissue damage due to high pressures from rigid anterior pelvic supports.

The following is a summary of currently available pelvic supports, with their deficiencies.

Wheelchair Setup: Orientation-in-Space (OIS): Tilting the wheelchair back uses gravity to hold the pelvis against the backrest. In this position it is difficult for the user to move the pelvis, trunk, and head. The user is left facing upward in a nonfunctional position. Tilting the seat forward activates extension muscles of the trunk and can be used only for short periods (e.g., 15minutes).

Seating Components

Anti-thrust seat (ATS): This type of seat provides a rear section which is lower than the front section. This is designed to hold the pelvis to the rear of the seat. However, the seat height transition can be a source of high pressure, and the pelvis, if not held securely, can move over the transition.

Contoured seat: This type of seat is shaped to conform to the user. It is designed to distribute pressure at the seat surface. The cushion's sloping shape often causes the hips to slide into improper postures. This seat is custom made and cannot be adjusted for growth or change.

Bi-angular back (BAB): This type of backrest provides rear support for the sacrum and upper pelvis. If the front of the pelvis is not supported properly, the BAB can push the user forward in the seat.

Lateral hip pads: These are used at the sides of the hips and are only effective in preventing the pelvis from moving laterally. They do not address lateral tilting of the pelvis.

Anterior pelvic supports

Lap belt: A single attachment lap belt used at a 45 to 90 degree angle to the seat surface is flexible and useful for controlling mild pelvic movement.

Four-point lap belt (translated pivot point): This device can provide more stability than a single attachment lap belt. However, it allows some movement of the pelvis and must be used with a sacral support to provide effective control of pelvic tilt.

Pelvic stabilizer (wide abduction pommel): This device is designed to apply an anterior force to the pelvis at the pubic bone. The pelvic stabilizer can be effective in maintaining the rearward position of the pelvis in the seat. However, if not monitored closely, this device can damage soft tissues.

Sub-ASIS bar: A straight or curved sub-ASIS bar is a rigid, padded bar designed to hold the pelvis just under the ASIS. It tends to be difficult to properly fit and can produce high pressures and tissues damage at the front of the pelvis.

Anterior knee blocks: This device is designed to apply a rearward force at the knee that is transmitted through the femur to the hip joints. This device allows forward tilting of the pelvis, and it relies upon the countering force of a sacral support. Anterior knee blocks and straps can cause further joint problems for users with compromised hip integrity. Some controversy exists about the practice of applying a constant force to the knee and hip joints, particularly in cases where high tone is present.

The following patents all pertain to wheelchairs and support devices therefor.

U.S. Pat. No. 5,678,798 discloses a swing support bracket assembly for mounting support pads to wheelchairs. The assembly includes a housing, an axle mounted for rotation in the housing, and a toggle pivotally mounted in the housing and having a tapered protrusion adapted to engage a cooperating tapered recess in the axle. The support pad may be mounted either directly or by a number of adjustable clamps and support rods to the housing. In another embodiment it is mounted by such rods and clamps to the axle.

U.S. Pat. No. 5,564,788 discloses a support system for maintaining a person in a substantially upright sitting position in a wheelchair, comprising a unitary frame and a unitary cushion. The unitary frame has front and back portions, and a generally rectangularly shaped central portion having upper and lower sections. A pair of upper lateral wing frame portions extend from the upper section of the central portion, and a pair of lower lateral wing frame portions extend from the lower section of the central portion. The unitary cushion is shaped to fit over the frame and comprises a generally rectangularly shaped central cushioned portion having upper and lower sections, a pair of upper lateral cushioned wing portions extending from the upper section of the cushioned central portion and a pair of lower lateral cushioned wing portions extending from the lower section of the cushioned central portion. The pairs of upper lateral wing frame portions and lateral cushioned wing portions, provide bracing to the left and right sides of the person's upper torso in a substantially upright position. The pairs of lower lateral frame wing portions and the upper lateral cushioned wing portions, prevent rotation of the person's pelvis. Each of the upper lateral wing frame and cushioned portions, the central frame and the cushioned sections, and each of the lower lateral frame and cushioned wing portions, are generally C-shaped when viewed from the side.

U.S. Pat. No. 5,447,356 discloses a chair for disabled persons with a supporting frame, a seat adjustably connected to the supporting frame by a hinge, and a back adjustably connected by a hinge to the rear of the seat. The seat has a front section which lies beneath and supports the upper legs of an occupant, and a rear section which lies beneath and supports the pelvis of an occupant. The front and rear sections can be fixed and adjusted independently of each other due to a hinge which is parallel to the hinge at the rear of the seat.

U.S. Pat. No. 4,813,746 discloses an angular bar mounted on each opposing lower portion of a wheelchair frame for securement of the pelvis of a person seated in the wheelchair. Each bar has a side portion that extends across the lateral region of the hip and a front portion that extends in front of the hips above the thighs. Universal adjustments with a quick release mechanism are provided for independent adjustment of each arm.

U.S. Pat. No. 4,073,537 discloses a device for positioning a patient in a chair having a back and arms. The device includes a pad for placement against the patient and a clamp which underlies an arm of the chair and is shiftable along the length of the arm independently of the back. The pad is connected to the clamp by a series of connecting members which permit universal swinging of the pad about a plurality of angularly disposed and laterally spaced axes. The pad also is mounted for shifting laterally of the attaching clamp and the arm to which it is attached and for shifting vertically and horizontally forwardly and rearwardly relative to the chair. A locking mechanism is provided for securing the pad in any of the infinitely selectable positions for the pad to maintain patient positioning with in the chair. A similar pad attached to the opposing arm on the chair also may be used to aid in patient positioning.

U.S. Pat. No. 3,640,571 discloses a trunk support for use with wheelchairs and the like having contoured trunk support plates disposed laterally of and in supporting contact with the patient's trunk. The plates are secured to the backrest of the chair, are universally moveable for adjustment to the patient's size and shape, and are locked in the supporting position. The plates can be opened to permit the patient to enter or alight from the chair. Stop means are provided so that each time the plates are moved into their trunk supporting position they return to an identical, predetermined position to thereby eliminate the need for adjustments of the plate while used with the same patient.

U.S. Pat. No. 3,704,910 discloses a cushioned torso engaging member adapted to be mounted to one or the other of the handles of a conventional wheelchair or the like either alone or in pairs, by means of an assembly of a handle clamp and linked arms which provide both for angular, elevational and dimensional adjustment of the position of the torso engaging member relative to the wheelchair handle.

SUMMARY OF THE INVENTION

The present invention includes a padded rear shell, two padded front shells, lateral hip pads, a pivot mechanism, a pivot limiter, a fore-aft lock, and attachment hardware. The rear shell supports the pelvis at the sacrum, the posterior superior ilian spines (PSIS's) and the sides of the pelvis. The width of the rear shell will be adjustable to provide a custom fit for each user. The two front shells support the front of the pelvis at and around the anterior superior iliac spines (ASIS's). Lateral hip pads at the greater torchanter are designed to prevent the pelvis from sliding to the sides.

The pivot mechanism allows anterior and posterior tilting of the pelvis. Adjustable centering springs help return the pelvis back to a neutral position and provide dynamic resistance to pelvic movement. The pivot limiter allows pivot movement of the invention, and the user's pelvis, for only a predetermined range of motion. Preferably, a separate adjustment for anterior and posterior tilt ranges allows adjustment of one independently of the other. The pivot limiter can be a mechanism separate from the pivot mechanism or, alternatively, the pivot limitation can be accomplished by the pivot mechanism. The pivot mechanism itself can limit pivot movement when, for example, the pivot mechanism is a spring, elastomeric or piston device. Pivot movement is then limited by the amount of force the user can provide against the pivot mechanism and still attain pivoting movement.

BRIEF DESCRIPTION OF THE DRAWINGS

These and other objects and features of the invention will become more fully apparent when the following detailed description of the invention is read in conjunction with the accompanying drawings.

FIG. 1 is a perspective view of one embodiment of the pelvic stabilization device of the present invention mounted to the seat frame of a wheelchair and having elastomeric bands as a pivot limiting and return apparatus;

FIG. 2 is a detailed perspective view of the rear pad, front pad, and the pelvic support brace attachment apparatus of FIG. 1;

DETAILED DESCRIPTION OF THE PREFERRED EMBODIMENTS

Figure 3:
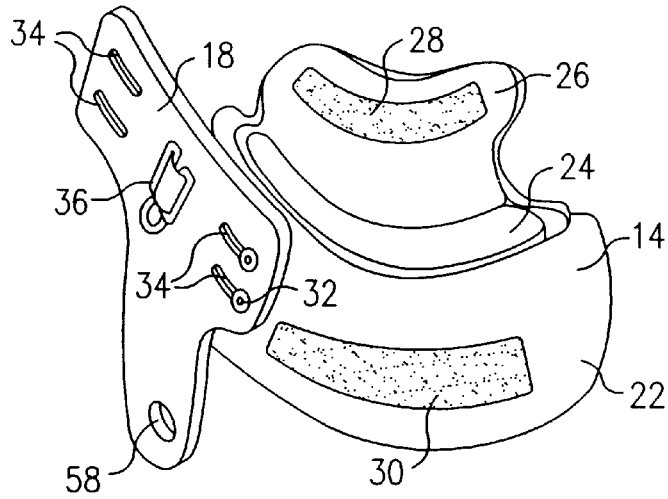
FIG. 3 is a detailed perspective view of the front pad and pad mount of FIG. 1.

Referring to FIGS. 1 through 4, a first embodiment of the pelvic stabilization device (2) of the present invention is shown. Pelvic stabilization device (2) is removably mountable onto wheelchair (4); wheelchair (4) including a seat frame (6) and a back frame (8). Pelvic stabilization device (2) includes pelvic support brace (10), which may be comprised of a substantially circular pad securing strap (12) with front pads (14) and rear pads (16) radially therearound. It is to be understood that strap (12) can be made of flexible natural or polymeric material, or alternatively can be comprised of a rigid material as are side supports (88) and rear support (90) of the embodiment of FIG. 5. As best shown in FIGS. 2 and 3, front pads (14) and rear pads (16) are attached to pad mount (18); one pad mount (18) being located on each side of pelvic support brace (10). As shown in FIG. 1, hip pads (20) are also located on pad mount (18), below front pads (14) and rear pads (16). As shown in FIGS. 1 through 5, front pads (14) and rear pads (16) preferably have a pad exterior shell (22) comprised of a thermo-formed plastic, into which is placed a foam insert (24). As best shown in FIG. 3, front pads (14) and rear pads (16) include a flap (26) that can be opened to provide access into the interior of pad exterior shell (22) for the placement of foam insert (24) therein. Flap (26) is releasably secured to pad exterior shell (22) by mating book and loop fasteners (28) and (30) on flap (26) and pad exterior shell (22), respectively. Front pads (14) and rear pads (16) are preferably contoured to comfortable mate with the exterior curves of the lower torso, i.e., hips, of the user. Still referring to FIG. 3, front pads (14) and rear pads (16) are removably attached to pad mount (18) by screws (32) which pass through fore/aft horizontal adjustment slots (34) of pad mount (18) and into either front pad (14) or rear pad (16). Note that the longitudinal orientation of fore/aft horizontal adjustment slots (34) of pad mount (18) allow front pads (14) and rear pads (16) to be placed longitudinally at a plurality of locations on pad mount (18) in order to accommodate the physical dimensions of different users. To further secure front pads (14) and rear pads (16) on pad mount (18), pad securing strap (12) passes through pad securing strap anchor (36), a buckle-like opening in pad mount (18).

Referring to FIGS. 1 and 2, pelvic support brace attachment apparatus (38) includes chair mounting bracket (40) that is attachable to seat frame (6) of wheelchair (4) by bolts placeable through bolt holes (42) of chair mounting bracket (40). Two chair mounting brackets (40) are present, one on each side of wheelchair (4). For users with pelvic rotation to vary the orientation of the pelvic support brace (10) with respect to the depth dimension of wheelchair seat (58), one of the two chair mounting brackets (40) can be located farther fore or aft along seat frame (6) than is the other chair mounting bracket (40). Chair mounting bracket (40) is a substantially L-shaped member in cross-section, having longitudinal slots (44) in the upper portion thereof, and bolt holes (42) in the lower portion thereof. Disk mounting bracket (46) is attachable to chair mounting bracket (40) by orientation of bolt holes (48) of disk mounting bracket (46) with longitudinal slots (44) located in the upper portion of chair mounting bracket (40), with subsequent placement of bolts through bolt holes (48) and through longitudinal slots (44). Note that disk mounting bracket (46) can be oriented at a plurality of heights along chair mounting bracket (40) due to the longitudinal orientation of slots (44); in this manner, the height of pelvic support brace (10) can be varied with respect to wheelchair (4) in order to accommodate the physical dimensions of different users. Furthermore, one disk mounting bracket (46) can be mounted higher or lower on its chair mounting bracket (40) than the other disk mounting bracket (46) is mounted on its chair mounting bracket (40) to vary the orientation of the pelvic support brace (10) with respect to the height dimension of wheelchair seat (58) in order to accommodate users with pelvic obliquity. Disk mounting bracket (46) has a plurality of spacer disks (50). Each spacer disk (50) is toroidal in shape, and the spacer disks (50) function to provide distance between seat frame (6) of wheelchair (4) and pelvic support brace (10), such that a narrower pelvic support brace (10) be employed by a user with smaller hips requires more spacer disks (15) between pelvic support brace (10) and pelvic support brace attachment apparatus (38) to secure pelvic support brace (10) to pelvic support brace attachment apparatus (38). To vary the location of pelvic support brace (10) along the width dimension of wheelchair seat (58), more or less disk spacers (15) can be placed on one pelvic support attachment apparatus (38) than are on the other pelvic support attachment apparatus (38). Ball joint (52) is centrally located in the spacer disk (50) adjacent pad mount (18). Ball joint (52) is rotatable with respect to spacer disks (50) and has threaded opening (54) centrally located therein. Pad mount (18) is attached to ball joint (52) by placement of pad mount attachment bolt (56) through pad mount hole (57) of pad mount (18) and into threaded opening (54) of ball joint (52). In this manner, pad mount (18) and pelvic support brace (10) is pivotable with ball joint (52) with respect to pelvic support brace attachment apparatus (38) and wheelchair (4) such that the horizontal plane of pelvic support brace (10) can pivot from being parallel to the horizontal plane of wheelchair seat (58) to being aparallel to the horizontal plane of wheelchair seat (58). The pivoting movement of pelvic support brace (10) can occur in two directions; in one direction rear pads (16) pivoting downward toward wheelchair seat (58) and front pads (14) moving upward away from wheelchair seat (58), and in the other direction rear pads (14) moving upward away from wheelchair seat (58) and front pads (14) moving downward toward wheelchair seat (58). The degree of fore or aft pivot of pelvic support brace (10) with respect to wheelchair (4) can be limited to a predetermined number of degrees by placement of a stop device adjacent ball joint (52) that blocks rotational movement of ball joint (52) after a predetermined amount of rotational movement has occurred. Note that ball joint (52) has three degrees of freedom with respect to the stationary elements of pelvic support brace attachment apparatus: rotational movement, fore and aft movement and up and down movement. These three degrees of freedom allow for the fore and aft pivoting of pelvic support brace (10) when the two chair mounting brackets (40) are asymmetrically oriented and/or the two disk mounting brackets are asymmetrically oriented to accommodate a user with pelvic obliquity and/or pelvic rotation.

Figure 4:
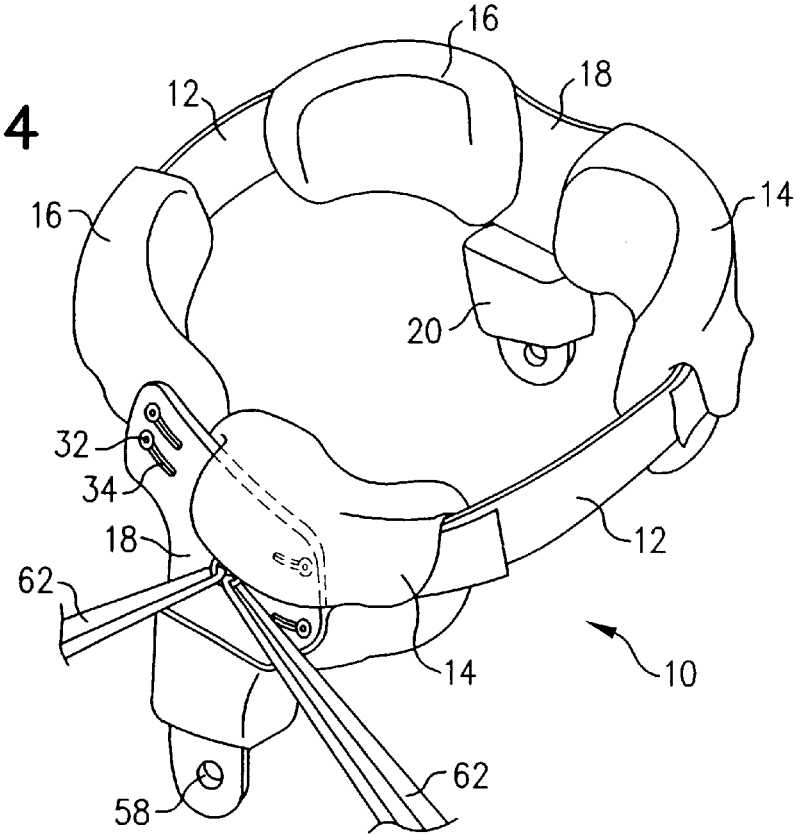
FIG. 4 is a detailed perspective view of the pelvic support brace and pivot limiting and return apparatus of FIG. 1.

Now referring to FIGS. 1 and 4, pivot limiting and return apparatus (60) is comprised of elastomeric band (62) and elastomeric band (64). Elastomeric bands (62) and (64) are attached to pad mount (18) at one end, and seat frame (6) of wheelchair (4) at the other end. Elastomeric bands (62) and (64) maintain pelvic support brace (10) in a neutral position such that the horizontal plane of pelvic support brace (10) is substantially parallel to the horizontal plane of wheelchair seat (58). If a slight offset from the horizontal plane of wheelchair (58) is desired, in the neutral position the elastomeric force of one of elastomeric bands (62) or (64) can be made greater than the elastomeric force of the other of elastomeric bands (62) or (64). Elastomeric bands (62) and (64) also limit the pivot movement of pelvic support brace (10) with respect to wheelchair (4) in both the fore and aft directions, based upon the amount of elasticity of elastomeric bands (62) and (64) in conjunction with the weight and strength of the user. In other words, after elastomeric band (62) or (64) has been stretched a predetermined amount upon pivoting of pelvic support brace (10), the user will not be able to pivot pelvic support brace (10) any further due to resistance encountered by the stretched elastomeric band (62) or (64). Elastomeric bands (62) and (64) also function to return pelvic support brace (10) to the neutral position described above after the user has ceased providing force against elastomeric band (62) or elastomeric band (64) and the user adopts a relaxed posture due to the characteristic of elastomeric band (62) and elastomeric band (64) to return to their non-extended configuration.

Figure 5:
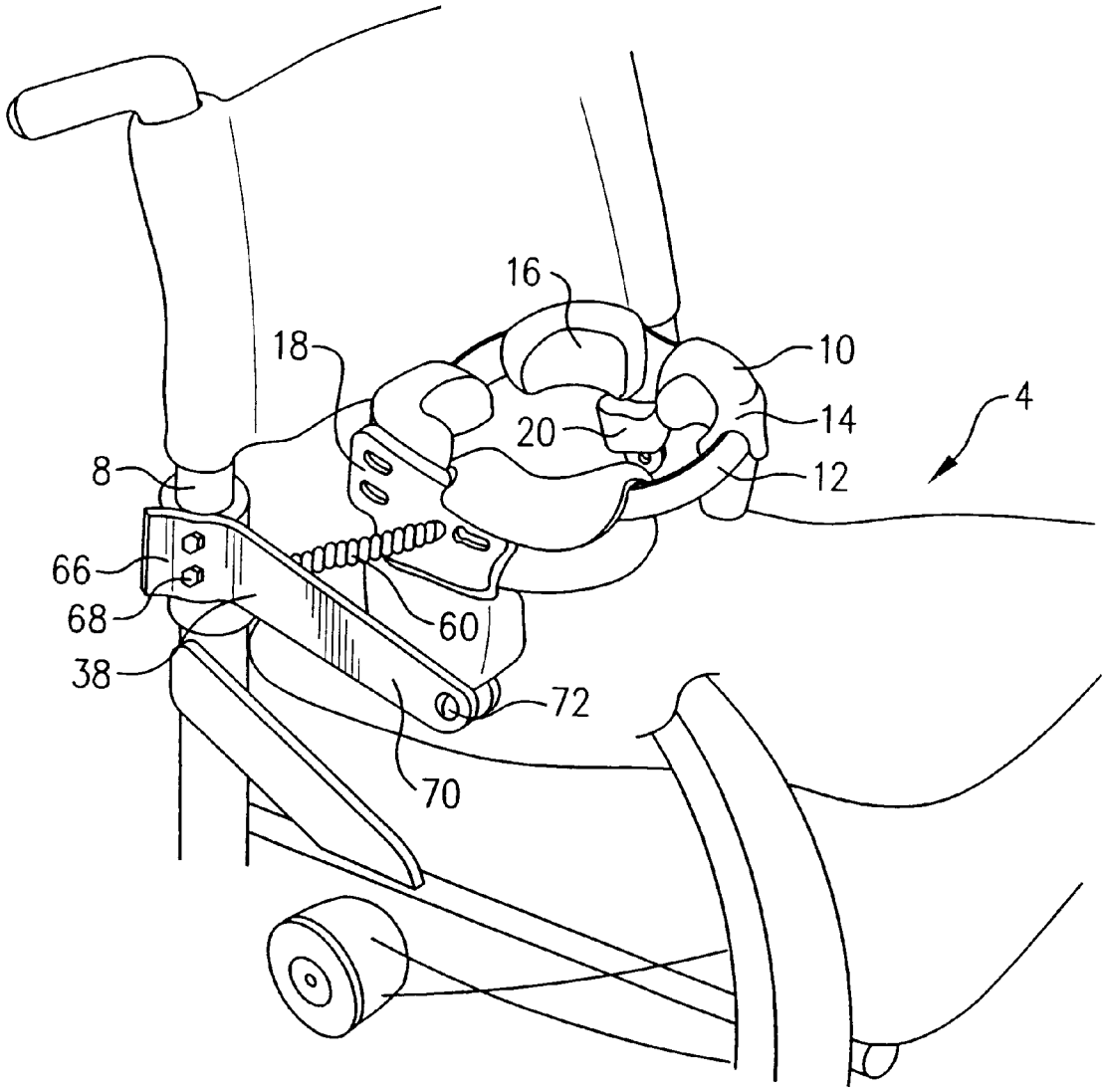
FIG. 5 is a perspective view of another embodiment of the pelvic stabilization device of the present invention mounted on the back frame of a wheelchair and having a spring-biased pivot limiting and return apparatus.
Figure 6:
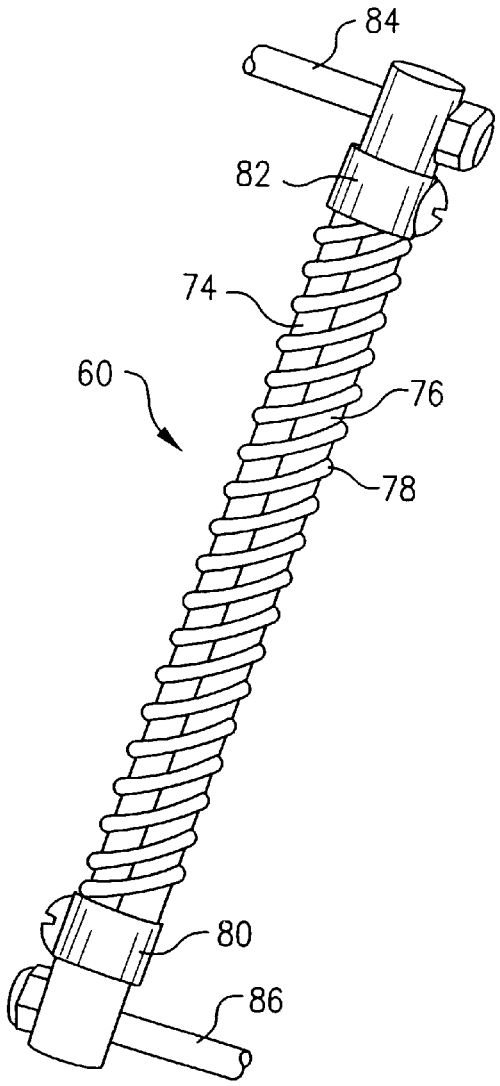
FIG. 6 is a detailed perspective view of the spring-biased pivot limiting and return apparatus in the non-extended orientation.
Figure 7:
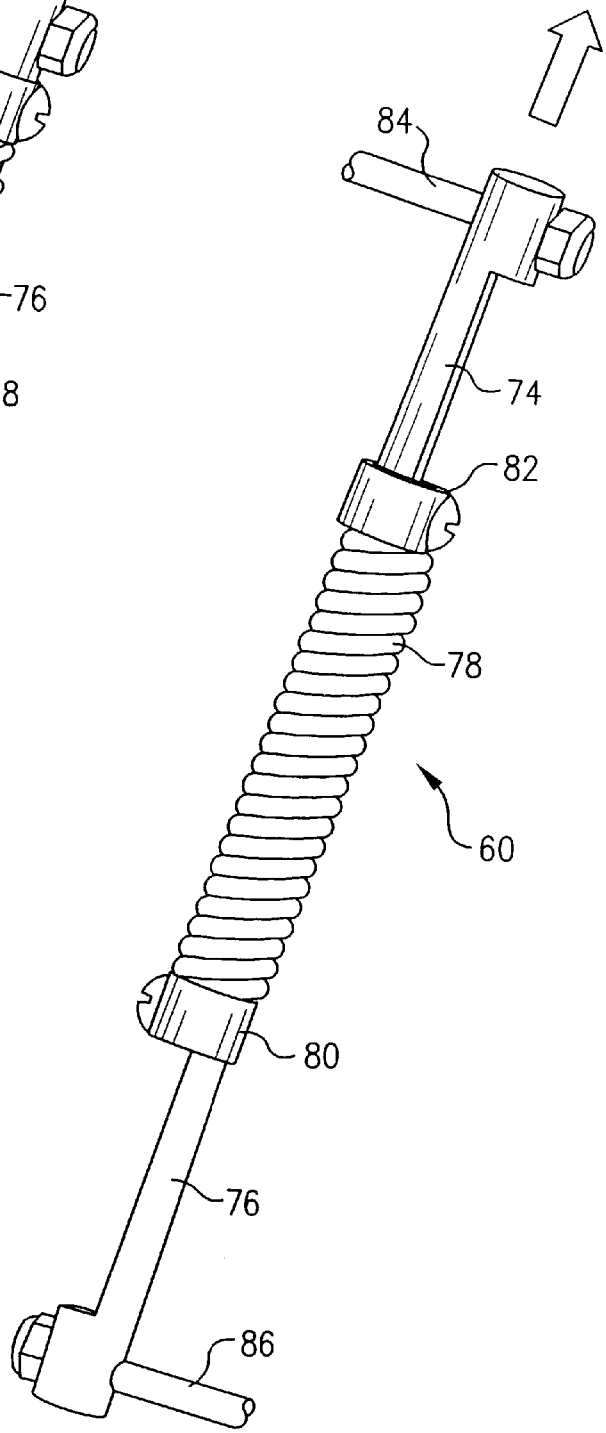
FIG. 7 is a detailed perspective view of the spring-biased pivot limiting and return apparatus in the extended orientation.

Referring to FIGS. 5 through 7, a second embodiment of the present invention is shown in which elements identical to the elements disclosed in FIGS. 1 through 4 of the first embodiment of the present invention have like element numbers. In the second embodiment of the present invention, pelvic support brace attachment apparatus is attachable to back frame (8) of wheelchair (4) as opposed to seat frame (6) thereof Pelvic support brace attachment apparatus includes a split collar (66) placeable over back frame (8). Subsequent to placing split collar (66) over back frame (8), collar bolts (68) are tightened to secure pelvic support brace attachment apparatus (38) to wheelchair (4). The height at which pelvic support brace (10) is placed on wheelchair (4) can be altered based on the location of pelvic support brace attachment apparatus (38) longitudinally on back frame (8). Pelvic support brace apparatus (38) also includes arm (70) with split collar (66) at one end thereof and disk mounting bracket bolt opening (72) at the other end thereof. As in the first embodiment of the present invention, as shown in FIG. 2, disk mounting bracket (46) is employed, and is secured to arm (70) of pelvic support brace attachment apparatus (38) of FIG. 5 by placement of a bolt through disk mounting bracket bolt opening (72) and into disk mounting bracket (46). Again, as shown in FIG. 2, spacer disks (50) and ball joint (52) having threaded opening (54) are also present and pad mount (18) is attached to disk mounting bracket (46) by placement of pad mount attachment bolt (56) through pad mount bolt (58) and into threaded opening (54) of ball joint (52). Still referring to FIG. 5, the second embodiment of the present invention has a pivot limiting and return apparatus (60). Pivot limiting and return apparatus (60) in FIG. 5, however, is not comprised of elastomeric bands but, instead, consists of a spring biased device that is substantially parallel with the longitudinal axis of arm (70) of pelvic support brace attachment apparatus (38). As shown in FIGS. 6 and 7, pivot limiting and return apparatus (60) includes a first rod (74) and a second rod (76) that are substantially parallel. Both first rod (74) and second rod (76) are located within spring (78). Spring (78) is fixedly attached at one end thereof to first rod collar (80) and at the other end thereof to second rod collar (82). First rod collar (80) is also secured to one end of first rod (74). Second rod collar (82) is secured to the end of second rod (76) most distantly located from the end of first rod (74) that is fixedly attached to first rod collar (80). The end of first rod (74) not attached to first rod collar (80) has pelvic support brace bolt (84) passing perpendicularly therethrough to attach pivot limiting and return apparatus (60) to pad mount (18) of pelvic stabilization device (2). Likewise, the end of second rod (76) not attached to second rod collar (82) has wheelchair bolt (86) passing perpendicularly therethrough to attach pivot limiting and return apparatus (60) to arm (70) of pelvic support brace attachment apparatus (38). In operation, pelvic support brace (10) is maintained in the desired neutral position, as shown in FIG. 6, when spring (78) is oriented in a non-biased configuration between first rod collar (80) and second rod collar (82). When the user of wheelchair (4) pivots forward to cause pivoting of pelvic support brace (10), as shown in FIG. 7, spring (70) is compressed between first rod collar (80) and second rod collar (82) as first rod (74) and second rod (76) move parallel with respect to each other, but in opposite directions. The amount of movement of first rod (74) and second rod (76), and thus the amount of movement of pelvic support brace (10) with respect to wheelchair (4), is a function of the degree to which spring (78) can be compressed, which is, in turn, a function of the spring force of spring (78) and the size and weight of the user of wheelchair (4). When the user of wheelchair (4) adopts a relaxed posture, spring (78) will again expand, as shown in FIG. 6, to return pelvic support brace to the neutral position with respect to wheelchair (4).

Figure 8:
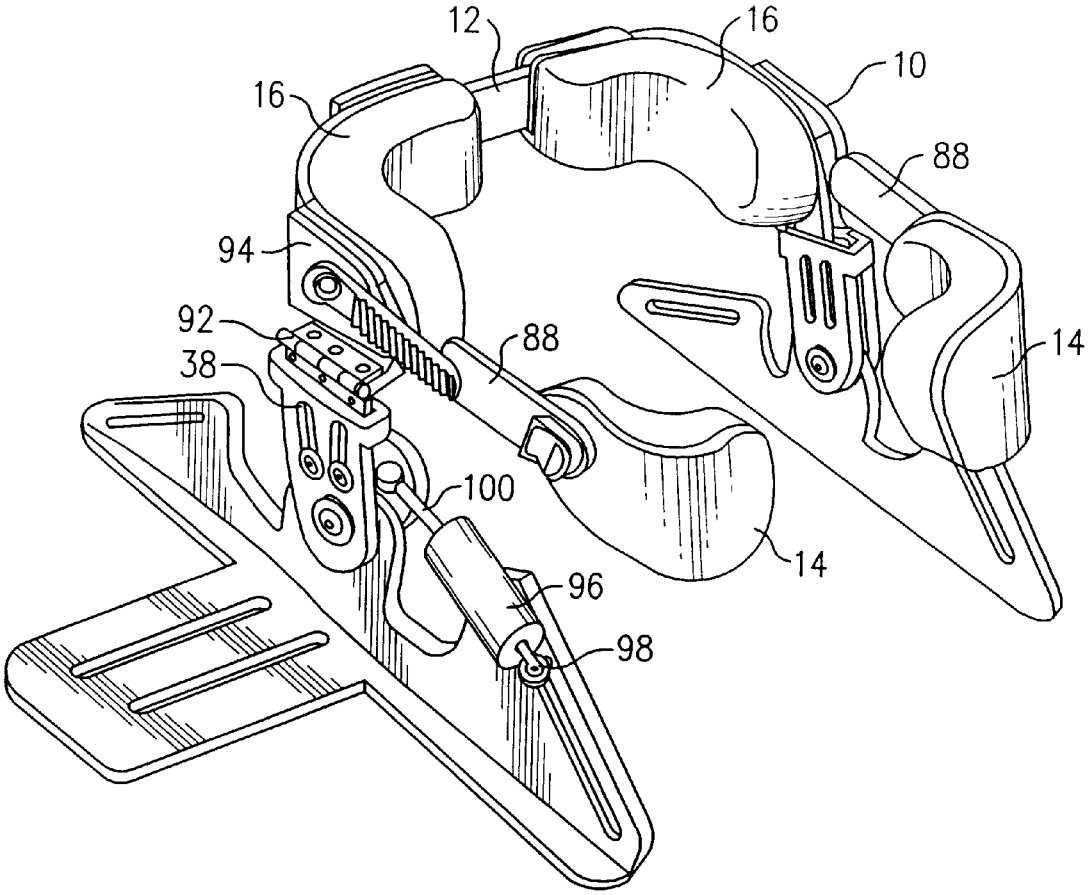
FIG. 8 is a perspective view of yet another embodiment of the pelvic stabilization device of the present invention having a gas piston-based pivot limiting and return apparatus.

Now referring to a third embodiment of the present invention, elements described herein that are the same as elements previously described in the first and second embodiments of the present invention use like element numbers. Pelvic support brace (10) of FIG. 8 is of a more rigid construction than pelvic support brace (10) of the first and second embodiments of the present invention as shown in FIGS. 1 through 7. Thus, pelvic support brace (10) of FIG. 8 lacks pad securing strap (12) at the front portion of pelvic support brace (10). Furthermore, side supports (88), comprised of a rigid plastic, are employed for lateral movement of front pads (14) to adjust the length of pelvic support brace (10). Rear support (90), comprised of a rigid plastic, also moves laterally to adjust the width of pelvic support brace (10) by moving rear pads (16) closer together or farther apart. As in the first embodiment of FIGS. 1–4, the two pelvic support brace attachment apparatuses (38), one of which is preferably located on each side of pelvic support brace (10), can each be moved vertically independently of one another, i.e., one pelvic support brace attachment apparatus (38) can be oriented higher or lower than the other, to accommodate users with pelvic obliquity. Hinge (92) is located between pelvic support brace bracket (94), which is attached to rear support (16), and pelvic support brace attachment apparatus (38). Hinge (92) allows fore and aft pivoting of pelvic support brackets, as discussed further below, without binding when the two pelvic support brace apparatuses (38) are oriented at different heights to accommodate the pelvic obliquity of the user.

In the third embodiment of the present invention, pivot limiting and return apparatus (64) includes gas charged piston (96) having a first end (98) attachable to seat frame (6) of wheelchair (4), and a second end having shaft (100) reciprocatable therein, and attachable to pelvic support brace bracket (94). Pelvic support brace bracket (94) pivots with pelvic support brace (10) with respect to wheelchair (4). As shown in FIG. 8, when pelvic support brace (10) is in the neutral position, shaft (100) of gas charged piston (96) is extended based upon the pressurized gas in gas charged piston (96). When the user of pelvic support brace (10) pivots forward, shaft (100) retracts into gas charged piston (96) an amount equivalent to the force applied by the user, thus limiting the pivot movement of pelvic support brace (10). When the user adopts a relaxed posture after pivoting, the gas in gas charged piston (96) expands, thereby extending shaft (100) outwardly from gas charged piston (96) to return pelvic support brace (10) to its neutral position with respect to wheelchair (4). It is readily apparent that a second gas charged piston (96) can be attached to pelvic support brace (10) and wheelchair (4) in an opposite orientation from the orientation of gas charged piston (96) shown in FIG. 8 in order to limit aft pivoting of pelvic support brace (10) with respect to wheelchair (4) and to return pelvic support brace (10) to its neutral position with respect to wheelchair (4) after aft pivoting has occurred. Gas charged pistons (96) of differing resistance can be employed for users of different weight.

EXAMPLE

Clinical evaluations were conducted to obtain objective measurements and subjective feedback from users and caregivers to assess fit and performance and to identify areas needing improvement. All evaluations were conducted at the Rehabilitation Technology and Therapy Center of Lucille Packard Children's Health Services at Stanford (RTTC) in Palo Alto, Calif.

Development of Seating Simulator. A seating simulator was developed for use during the Phase I clinical evaluations. It was used to simulate the components currently used in each participant's seating system and to mount the pelvic stability device. Comparing the subject's current seating in his/her own wheelchair to sitting in a simulator with the pelvic stabilization device would not be an accurate comparison. Therefore, a facsimile of each subject's current seating system was set up in the simulator to compare with the pelvic stability device in the simulator. The simulator consisted of a PinDot casing frame mounted to a wheelbase with added tracks along the seat and backrest to which various seating components could be mounted. The locations of the subject's existing components were recorded. Seating components that were available to simulate the subject's existing seating included various sized and shaped sub-ASIS bars, several seat belts, various shoulder straps and harnesses, lateral trunk supports, lateral hip pads, an anti-thrust seat, a bi-angular back, an abductor, and thigh adductors.

Subject Selection. Potential participants were recruited through the Stanford RTTC, Parents Helping Parents, and United Cerebal Palsy. All potential subjects were screened by telephone by the project clinician. Those excluded from participation included persons with severe orthopedic deformities, abnormal tone or movement disorders, or a delicate medical condition (e.g., arthrogryposis, spinal muscular atrophy, osteogenesis imperfecta, sores or bruises in the pelvic area, hip joint pain when sitting, fragile bones, respiratory illness that is affected by sitting upright, general weakness). Subjects selected for participation used a wheelchair as their primary means of mobility, had a history of problems controlling pelvic posture in their wheelchair, and were capable of demonstrating some form of communication ("yes" and "no" either directly or through an interpreter).

A total of 20 wheelchair users participated in the study. All study participants had cerebral palsy, although this was not a requirement. The subject group consisted of 15 (75%) males and 5 (25%) females, ranging from 8.7 to 50.6 years of age, with an average age of 23.3 years.

Clinical Assessment The clinical assessments were conducted by the project clinician and a Stanford RTTC physical or occupational therapist. After informed consent was obtained, the clinical assessments were conducted as follows:

1. Background information was obtained including diagnosis/disability, relevant orthopedic problems, areas of pain or discomfort, method of communication (participant and caregiver were asked to demonstrate communication of "yes", "no," "pain", and other appropriate words or concepts), skin condition, history with regard to pressure ulcers, bruises or areas of risk, and level of sensation.

2. Range of motion and flexibility of pelvis, trunk, hip and knee joints, and hamstring tightness were measured with subject in supine position.

3. Postural tendencies in sitting were observed and recorded. Muscle tone was characterized as athetoid, ataxic, or spastic, and high, low, and/or mixed.

4. Level of support needed for good stability was recorded as hands free, uses hands, requires support at pelvis, or requires support higher than pelvis.

5. Measurements of the pelvis were taken with the subject supported in sitting at the edge of a firm mat in an upright and neutral posture. Pelvic measurements included: width of pelvis (from left and right iliac crest), greater trochanter distance between left and right PSIS, width of hips at greater trochanter, height of PSIS at seat surface, height of iliac crest from seat surface, distance between left and right ASIS, depth of pelvis (from ASIS to PSIS), a seat surface to top of proximal thigh, height of ASIS from seat surface, and circumference at top of pelvis. A flexible ruler was used to trace a cross section of the pelvis at the waistline, front and back.

Wheelchair and Seating System Specifications. The following wheelchair and seating system specifications were recorded: wheelchair manufacturer and model, manual or powered wheelchair, tubing diameter, width, height, depth, age of wheelchair, age of seating system, date of last adjustment/modification. The types of seating components used in the current seating system were recorded in the following categories: seat, pelvic support, backrest, headrest, leg support, foot support and arm support. Detailed measurements and angles of support surfaces were also recorded.

Setup and Fitting of Seating Simulator with Current Components. A multi-adjustable seating simulator was configured to simulate the subject's existing seating system. Feedback from the subject and/or caregiver was recorded and used to ensure a comfortable fit. Small, rectangular, custom-designed FSA (Force Sensing Array) pressure measurement mats were placed between the subject and any support surface at the front and rear of the pelvis. Pressure readings were taken and examined to ensure proper fit of the pelvic support components. If high pressure readings were observed, the subject was asked to comment on any discomfort and the project clinician palpated the area in question. The simulator was adjusted and the subject was repositioned until the high pressure areas were eliminated.

Antorpometric Measurements. with the subject seated on a firm mat, measurements were taken to determine the appropriate size pelvic stability device shell to be tested and to optimize the size ranges of the other components of the invention. Using a flexible ruler, the front (around the ASIS's) and back (around the PSIS's) of the pelvis was traced.

Postural Measurements in Simulator with Current Components. Postural measurements were made with the subject seated in the simulator that was set up to mimic the subject's current wheelchair seating system. Anterior/posterior pelvic tilt was measured in degrees with the PALM (PALpation Meter) positioned at the ASIS and PSIS, or in centimeters by measuring the distance from the ASIS to the lateral condyle of the knee. Pelvic obliquity was measured in degrees using the PALM positioned at the left and right iliac crests. The height of the top of the head was measured from a fixed reference point along the backrest. Forward pelvic movement was measured from the lateral condyle of the femur to a fixed reference point at the front of the seat. Trunk angle was measured using a modified inclinometer with adjustable arms positioned between the sternal notch and the xyphoid process.

Functional Tests in Simulator with Current Components. Each subject was used as his/her own control. Functional performance with use of the invention was compared to the simulated current seating system. Simple, objective tests were developed to assess the subject's functional abilities in the simulated current seating system and the invention. The tests were selected or designed to fit the functional abilities of the individual. These tests included: (1) part-time activation of a hand switch with auditory feedback; (2) reaching distance to a hand switch or pre-determined object; (3) timed knocking down a series of dominoes set at a fixed distance from the participant; (4) timed reaching and touching predetermined objects; (5) timed domino placement; (6) number of successful attempts to grab a pen at a fixed distance from the participant; (7) number of balls thrown into a bucket at a fixed distance; (8) timed handwriting a predetermined sentence or phrase; (9) timed typing of a predetermined sentence; (10) four-point laser race with laser attached to headband; (11) head switch activation count within pre-determined period of time; and (12) timed activation of a foot switch. Three trials of the selected activity were performed and scores recorded for each. Pressure readings were taken with the FSA (Force Sensing Array) Pressure Measurement System (Vista Medical) during the functional activity and again after the functional activity to identify any high pressure areas that occurred during the activity.

Postural Measurement in Simulator with Current Components. Postural measurements were repeated after the functional test was performed in order to record any changes in posture due to the activity.

Fitting and Adjustment of the Invention. The subject was then transferred to the mat in order to allow for installation of the invention into the simulator and to check for redness of the skin at the ASIS, PSIS, sacrum, and ischial tuberosities. Seating components (such as lower backrest, lateral hip pads, sub-ASIS bar, and lap belt) that were used in the simulator were removed. The appropriate size invention (small or large) was selected, mounted into the simulator, and adjusted based on the subject's pelvic measurements. The subject was then transferred into the simulator with the invention and minor adjustments were made. The amount of dynamic resistance was selected based on the subject's tone and range of motion. The range of anterior/posterior pelvic tilt allowed by the invention was adjusted based on flexibility, balance, and feedback from the subject. Pad shapes and settings were modified and adjusted based on feedback, pressure reading, and palpation of the pelvis. Feedback on comfort was obtained from the participant. The evaluation did not continue until the participant conveyed that he/she was comfortable.

Postural Measurements in Simulator with the Invention. After the invention was adjusted to properly fit the participant, postural measurements were taken.

Functional Test in Simulator with the Invention. The same functional test(s) was then repeated with use of the invention. Pressure readings were taken with the FSA during the functional activity and again after the functional activity to identify any high pressure areas that occurred during the activity.

Postural Measurements in Simulator with the Invention. Postural measurements were repeated after the functional test was performed in order to record any changes in posture due to the activity.

Subjective Feedback. Feedback was obtained through an interview process. The participant, parent or caregiver, and therapist and/or clinician were asked questions regarding level of comfort, perceived stability, aesthetics, differences between the invention and the original seating system, pros and cons of the invention, priorities regarding pelvic support, ease of use, possible benefit for this particular participant, durability, impact on function, integration into the normal activities of the user, and design improvement suggestions.

Results of Clinical Evaluation. The clinical evaluations revealed much about pelvic movements in persons with cerebral palsy and how these movements need to be controlled. The need for a pelvic stabilization device that offers versatility, permits movement, provides stability and enhances function in persons with cerebral palsy was clearly demonstrated.

All 20 study participants relied on specialized seating in their wheelchairs and had difficulties achieving and maintaining good sitting posture. The invention was shown to decrease unwanted pelvic movement and increase function by providing a stable base of support. The postural measurements taken during the evaluations indicated that the invention controlled pelvic posture in 80% of the subjects tested. Half (50%) of the subjects who were evaluated indicated that it was more comfortable than their current seating system.

The average user needed less support in front of the pelvis that those with strong extensor tone. Although the range of anterior/posterior pelvic tilt permitted with the invention was small, this dynamic component of the system provide to be extremely beneficial to some users. Dynamic stabilization provided by the invention allowed pelvic movement to occur, and then gently assisted the pelvis in moving back into the desired position. The dynamic component of the invention led to improved motor function in approximately 70% of the subjects tested. The dynamic stabilization achieved with the invention also resulted in a decrease in muscle tone exhibited by the user. The user evaluation demonstrated the benefits of dynamic pelvic positioning for persons with cerebral palsy over devices that provide static positioning.

What is claimed is:

1. A pelvic stabilization device attachable to a wheelchair and adapted to a portion of a torso of a user, said pelvic stabilization device comprising:

a pelvic support brace;

means for attaching said pelvic support brace to a wheelchair;

pivot means for pivoting movement of said pelvic support brace with respect to said means for attaching said pelvic support brace based upon force from the torso of the user, said pelvic support brace pivotable between a first, neutral position and a second, tilted position based upon force from the torso of the user; and pivot limiting and return means attached to said pelvic support brace to limit the amount of pivot of said pelvic support brace that is inducible by said pivot means and to return said pelvic support brace to said first, neutral position from said second tilted position.

2. The pelvic stabilization device of claim 1 wherein said pelvic support brace is comprised of two rear portions, two front portions, and two lateral hip portions.

3. The pelvic stabilization device of claim 1 wherein said pivot limiting and return means is attached to said means for attaching said pelvic support brace to a wheelchair.

4. The pelvic stabilization device of claim 1 wherein said pivot limiting and return means is a spring.

5. The pelvic stabilization device of claim 1 wherein said pivot limiting and return means is an elastomeric band.

6. The pelvic stabilization device of claim 1 wherein said pivot limiting and return means is a gas-containing piston.

7. The pelvic stabilization device of claim 1, further comprising a hinge between said pelvic support brace and said means for attaching said pelvic support brace to a wheelchair, said hinge allowing movement of said pelvic support brace to accommodate variable orientation of said pelvic support brace on said wheelchair.

8. The pelvic stabilization device of claim 1, further comprising means for adjusting a vertical distance of said pelvic support brace from a wheelchair.

9. The pelvic stabilization device of claim 1 wherein said pivot limiting and return means has a resistance to force applied by a user against said pelvic support brace, said resistance to force of said pivot limiting and return means being variable.

10. The pelvic stabilization device of claim 1 wherein said pivot means pivots movement of said pelvic support brace between said first, neutral position and said second, tilted position, and between said first neutral position, and a third, tilted position, said third position being in an opposite direction than said second, tilted position.

11. A pelvic stabilization device attachable to a wheelchair, the wheelchair having a seat portion having a width dimension, a depth dimension, and a height dimension, said pelvic stabilization device comprising:

a pelvic support brace having a fore portion and an aft portion;

means for attaching said pelvic support brace to a wheelchair;

pivot means for pivoting movement of said pelvic support brace with respect to said means for attaching said pelvic support brace, said pelvic support brace pivotable between a first, neutral position and a second tilted position;

pivot limiting and return means attached to said pelvic support brace to limit the amount of pivot of said pelvic support brace that is inducible by said pivot means and to return said pelvic support brace to said first, neutral position from said second, tilted position, first means and second means for adjusting the pelvic support brace laterally across the width dimension of the seat portion of the wheelchair, the first means and second means for adjusting the pelvic support brace laterally being independently adjustable from one another across the width dimension of the seat portion of the wheelchair;

first means and second means for adjusting the pelvic support brace horizontally along the depth dimension of the seat portion of the wheelchair, the first means and second means for adjusting the pelvic support brace horizontally being independently adjustable from one another along the depth dimension of the seat portion of the wheelchair; and first means and second means for adjusting the pelvic support brace vertically above the height dimension of the wheelchair, the first means and second means for adjusting the pelvic support brace vertically being independently adjustable from one another above the height dimension of the seat portion of the wheelchair.

12. The pelvic stabilization device of claim 11 wherein said pelvic support brace is comprised of two rear portions, two front portions and two lateral hip portions.

13. The pelvic stabilization device of claim 11 wherein said pivot limiting and return means is attached to said means for attaching said pelvic support brace to a wheelchair.

14. The pelvic stabilization device of claim 11 wherein said pivot limiting and return means is a spring.

15. The pelvic stabilization device of claim 11 wherein said pivot limiting and return means is an elastomeric band.

16. The pelvic stabilization device of claim 11 wherein said pivot limiting and return means is a gas-containing piston.

17. The pelvic stabilization device of claim 11 further comprising a hinge between said pelvic support brace and said means for attaching said pelvic support brace to a wheelchair, said hinge allowing movement of said pelvic support brace to accommodate variable orientation of said pelvic support brace on said wheelchair.

18. The pelvic stabilization device of claim 11 further comprising means for adjusting a vertical distance of said pelvic support brace from a wheelchair.

19. A pelvic stabilization device attachable to a wheelchair, the wheelchair having a seat portion having a width dimension, a depth dimension, and a height dimension, said pelvic stability device comprising:

a pelvic support brace;

means for attaching the pelvic support brace to a wheelchair;

first means and second means for adjusting the pelvic support brace laterally across the width dimension of the seat portion of the wheelchair, the first means and second means for adjusting the pelvic support brace laterally being independently adjustable from one another across the width dimension of the seat portion of the wheelchair;

first means and second means for adjusting the pelvic support brace horizontally along the depth dimension of the seat portion of the wheelchair, the first means and second means for adjusting the pelvic support brace horizontally being independently adjustable from one another along the depth dimension of the seat portion of the wheelchair; and first means and second means for adjusting the pelvic support brace vertically above the height dimension of the seat portion of the wheelchair, the first means and second means for adjusting the pelvic support brace vertically being independently adjustable from one another above the height dimension of the seat portion of the wheelchair.

* * * * *